US009248353B1

(12) United States Patent
Koenig et al.

(10) Patent No.: US 9,248,353 B1
(45) Date of Patent: Feb. 2, 2016

(54) GOLF CLUB TRACKING SYSTEM

(71) Applicants: Jesse Daniel Koenig, San Francisco, CA (US); Matthew Charles Smiley, San Diego, CA (US); Guy McIlroy, Los Gatos, CA (US); John Haggis, San Jose, CA (US)

(72) Inventors: Jesse Daniel Koenig, San Francisco, CA (US); Matthew Charles Smiley, San Diego, CA (US); Guy McIlroy, Los Gatos, CA (US); John Haggis, San Jose, CA (US)

( * ) Notice: Subject to any disclaimer, the term of this patent is extended or adjusted under 35 U.S.C. 154(b) by 0 days.

(21) Appl. No.: 14/077,212

(22) Filed: Nov. 12, 2013

Related U.S. Application Data

(63) Continuation-in-part of application No. 12/943,926, filed on Nov. 10, 2010, now Pat. No. 8,581,727.

(60) Provisional application No. 61/737,099, filed on Dec. 14, 2012.

(51) Int. Cl.

| | |
|---|---|
| ***G08B 13/14*** | (2006.01) |
| ***A63B 57/00*** | (2015.01) |
| *A63B 55/00* | (2015.01) |

(52) U.S. Cl.
CPC ..... *A63B 57/00* (2013.01); *G08B 13/1427* (2013.01); *G08B 13/1436* (2013.01); *A63B 2055/001* (2013.01)

(58) Field of Classification Search
CPC ..... A63B 2055/001; G08B 13/1427; G08B 13/1436
USPC ..... 340/568.6, 10.31, 571; 206/315.2
See application file for complete search history.

(56) References Cited

U.S. PATENT DOCUMENTS

| | | | | |
|---|---|---|---|---|
| 4,042,918 | A | 8/1977 | Klitzman | |
| 4,489,314 | A | 12/1984 | Miller | |
| 4,822,052 | A | 4/1989 | Dimmick | |
| 5,565,845 | A | 10/1996 | Hara | |
| 5,782,443 | A | 7/1998 | La Fontaine | |
| 5,844,483 | A | 12/1998 | Boley | |
| 5,952,921 | A | 9/1999 | Donnelly | |
| 5,973,596 | A | 10/1999 | French | |
| 6,023,225 | A | 2/2000 | Boley | |
| 6,057,762 | A | 5/2000 | Dusza | |
| 6,118,376 | A | 9/2000 | Regester | |
| 6,331,817 | B1 | 12/2001 | Goldberg | |
| 6,366,205 | B1 | 4/2002 | Sutphen | |
| 6,377,175 | B1 | 4/2002 | Williams | |
| 6,407,667 | B1 | 6/2002 | Jackson | |
| 6,411,211 | B1 | 6/2002 | Boley | |
| 6,753,778 | B2 | 6/2004 | Kruger | |
| 6,774,792 | B1 | 8/2004 | Williams | |
| 6,788,199 | B2 | 9/2004 | Crabtree | |
| 7,004,848 | B2 | 2/2006 | Konow | |
| 7,106,195 | B2 | 9/2006 | Keays | |
| 7,121,962 | B2 * | 10/2006 | Reeves | 473/407 |
| 7,134,302 | B2 | 11/2006 | Gorst | |
| 7,148,801 | B2 | 12/2006 | Crabtree | |
| 7,205,894 | B1 | 4/2007 | Savage | |

(Continued)

*Primary Examiner* — John A Tweel, Jr.

(57) ABSTRACT

Apparatuses, methods, and systems for tracking movements of golf clubs and alerting a golfer when one or more golf clubs are misplaced from a group of golf clubs. A peripheral unit is associated with and affixed to each of a number of golf clubs, and transmits signals that are detected and collectively processed by a base unit to determine the status of those clubs. A club may be designated as misplaced based on the sequence and timing of status events, upon which an alarm is activated to alert the golfer. Also the base unit may process signals regarding movement of golf clubs in conjunction with location data from a Global Positioning System device to obtain information regarding the user's golf performance.

20 Claims, 9 Drawing Sheets

(56) References Cited

U.S. PATENT DOCUMENTS

| | | | | |
|---|---|---|---|---|
| 7,605,705 | B2 | 10/2009 | Kritt | |
| 8,581,727 | B1 * | 11/2013 | Koenig et al. | 340/568.6 |
| 2006/0255918 | A1 | 11/2006 | Bernstein | |
| 2007/0191126 | A1 | 8/2007 | Mandracken | |
| 2009/0233735 | A1 | 9/2009 | Savarese | |
| 2013/0267339 | A1 * | 10/2013 | Boyd et al. | 473/223 |

* cited by examiner

GOLF CLUB TRACKING SYSTEM

CROSS REFERENCE TO RELATED APPLICATIONS

This application is a continuation in part of U.S. patent application Ser. No. 12/943,926 filed Nov. 10, 2010 and claims priority of U.S. Provisional Patent Application Ser. No. 61/737,099 filed Dec. 12, 2012. Priority of the aforementioned filing dates are hereby claimed and the disclosures of the Patent Application and Provisional Patent Application are hereby incorporated by reference in their entirety.

BACKGROUND OF INVENTION

I. Field of the Invention

The present disclosure relates to a system of devices that acts to track movements of items for various purposes including to alert the user that an item has been misplaced. In particular, the present disclosure relates to tracking movements of golf clubs and alerting a golfer that a golf club has been misplaced. In the context herein, it should be understood that a misplaced golf club is a golf club that has been lost, accidentally left behind, forgotten, or otherwise not returned to the golf bag or to close proximity to the golf bag due to circumstances other than the use of the golf club as part of normal golf play.

II. Description of Related Art

There are several known approaches to solving the problem of misplaced golf clubs. However, shortcomings are apparent in each of the systems disclosed in the past. U.S. Pat. No. 6,366,205 describes a system comprising sensors associated with golf clubs and an interrogator operative to obtain an inventory of golf clubs present in a golf bag and a controller operative to detect the absence from an inventory of a club that was present in a previous inventory. The absent club is treated by this system as "missing", and the system responds by activating an alarm. However, in the vast majority of cases in practice, the absent club would actually be in use by the golfer, not misplaced, creating a constant annoyance to the user as the alarm was activated each time a club was used as part of normal play.

U.S. Pat. Nos. 4,042,918, 4,489,314, 5,565,845, 6,377,175 and 6,774,792 require that an apparatus be fitted to the top of a golf bag or inside a golf bag, with individual holes or tubes, one for each golf club, each hole or tube containing an electromechanical switch or other sensor to detect the presence of a golf club. This apparatus would be bulky and require myriad versions to fit the myriad different shapes and sizes of golf bags, making such prior art examples quite expensive and cumbersome to the user. Furthermore, it would be inconvenient for the golfer to be required to carefully place a golf club in a fitted hole or tube within the bag.

U.S. Pat. Nos. 4,042,918, 6,366,205, 6,411,211 and 7,605,705 include methods that do not detect when a club has been actually misplaced, nor activate an alarm appropriately, instead just activating an alarm whenever a club is removed from the bag, which could cause a constant annoyance to the user as clubs are removed during normal play.

U.S. Pat. Nos. 5,952,921, 6,057,762 and 6,118,376 comprise devices attached to golf clubs wherein the devices transmit, reflect, or in some way emit radio-frequency (RF) signals, and further comprise an RF receiver attached to the golf bag, with an alarm that is activated if an emitting device is beyond a certain threshold distance from the receiver. This method implies that the emitting device must be in RF contact with the receiver during all normal play and should be out of RF contact only in the case of a lost or misplaced place. Clubs may be more than 100 yards away from the receiver during normal play (whether the receiver is attached to the golf bag or carried by the golfer). Therefore, the emitting device must be able to transmit a signal continuously to the receiver over distances greater than 100 yards. This is problematic because it requires a relatively high-power emitting device, and thus the device is relatively expensive and requires relatively large batteries, which would have relatively short life. Also, additional problems could arise if there were any trees, buildings, hills, or other obstacles between the club and the receiver as would often occur during normal play, in which case the RF link would be broken and the alarm would activate, erroneously indicating a misplaced club.

U.S. Pat. No. 5,782,443 is a mechanical device meant to enable a golfer to put down a golf club in such a way that it is held vertically so that it will be easily visible and thus will supposedly not be lost or misplaced. Such devices are cumbersome for the golfer to carry and disrupt normal play to some degree. Also, the golfer must remember to carry the device whenever he will have occasion to place a club down on the ground, which largely defeats the purpose of a lost club prevention system—to alleviate problems caused by forgetfulness.

U.S. Pat. No. 6,407,667 includes an RF transmitter not attached to a golf club, but contained in a separate device upon which a golf club is meant to be rested when it is placed down on the ground. It communicates via RF with a receiver that is meant to be carried on the golfer's person, and an alarm is activated if the distance between the receiver and transmitter exceeds a certain threshold distance. This type of system is cumbersome because it requires the golfer to carry extra devices; it is disruptive to the normal style of play; and since it requires the golfer to remember to use the device whenever he places a club down on the ground, it largely defeats the purpose of a lost club prevention system—to alleviate problems caused by forgetfulness.

U.S. Pat. No. 7,205,894 requires that a belt or some other apparatus be wrapped around the golf bag. This will be undesirable to the golfer because such an apparatus will be unsightly and will likely impede access to and desired use of the pockets, handles, and carrying straps of the golf bag.

Accordingly, there is a need for a system that reliably alerts the golfer when a club has been misplaced (as opposed to alerting the golfer that a club is in use), does not utilize a large amount of energy, and does not disrupt the golfer's normal style and method of play.

All references cited herein are incorporated herein by reference in their entireties.

SUMMARY OF THE INVENTION

The present invention is a system for tracking movements of golf clubs and alerting a golfer when one or more golf clubs are misplaced from a group of golf clubs comprising a peripheral unit associated with each golf club of the group of clubs, a base unit in communication with each peripheral unit and an alarm that alerts the golfer when a golf club has been misplaced. The tracking functionality may also be employed to record certain data related to aspects of the golfer's performance such as number of strokes taken and resulting score, and the distances balls are hit with each club.

In one aspect of the present invention a system for alerting a golfer when one or more golf clubs are misplaced from a group of golf clubs is disclosed comprising a peripheral unit associated with each golf club and a base unit with an alarm. Each peripheral unit may have a limited range and may be operative to transmit and detect signals throughout that limited range. The peripheral unit may also comprise a memory operative to store a unique identifier that it transmits periodically or when requested by the base unit.

The base unit may have a similar limited range and may be operative to transmit and detect signals from each peripheral unit throughout that limited range. It may also comprise a memory operative to store one or more unique identifiers transmitted by the one or more peripheral units and a processor operative to perform periodic inventories of the group of golf clubs wherein the periodicity is controlled by a polling timer, compare the most recent inventory with the previous inventory to determine which golf clubs have been recently removed from the group of golf clubs or returned to the group of golf clubs, initiate a removal timer when a golf club is removed from the group of golf clubs, and initiate a return timer when a golf club is returned to the group of golf clubs.

The system may identify a golf club as absent from the group of golf clubs when the peripheral unit of the golf club is outside the limited range and thus its associated unique identifier is not received by the base unit. Or the system may identify a golf club as absent from the group of golf clubs if a motion sensor such as a 3-axis accelerometer in the peripheral unit of the golf club senses that the club has been removed from the golf bag. An absent golf club is determined to be misplaced if and when the removal timer and the return timer have expired. When the absent golf club is determined to be misplaced an alarm is initiated to alert the golfer.

In one embodiment of this aspect of the invention, the system is operative by an electrical power source, such as by a battery or one or more photo-voltaic cells. In addition, the electrical power source may be activated by a light sensor and/or a motion sensor.

In another embodiment, the base unit processor is further operative to initiate a maximum duration timer for each golf club removed from the group of golf clubs wherein expiration of the maximum duration timer initiates the alarm.

In yet another embodiment, the system further comprises a display screen such as a liquid crystal or an organic light-emitting diode display screen. The display screen may be operative to indicate the number of golf clubs in the group of golf clubs or absent from the group of golf clubs, the remaining battery charge of the base unit, and/or the remaining battery charge of the peripheral unit associated with each golf club. In addition, the system may further comprise a keypad operative to adjust the removal timer, the return timer, the polling timer and/or the maximum duration timer.

In yet another embodiment, the base unit may comprise a mobile personal device such as mobile telephone, which may communicate with the peripheral units via means inherent to the device such as a Bluetooth Low Energy RF system. This mobile personal device may contain a Global Positioning System (GPS) device, which may be used in conjunction with information regarding the golf club movements to record certain data related to aspects of the golfer's performance such as the distances balls are hit.

In yet another embodiment, the peripheral unit is affixed to the end of the grip portion of each golf club of the group of golf clubs. In addition, the peripheral unit may further comprise an alerting means, such as a light emitting diode, for alerting the user that the remaining charge of the battery is low.

In another aspect of the invention, a method is disclosed for detecting one or more misplaced golf clubs from a group of golf clubs comprising: periodically inventorying golf clubs in the group of golf clubs, whereby a unique identifier response is transmitted from a peripheral unit associated with each golf club; storing the unique identifier received from each peripheral unit in a memory; comparing the unique identifier received from each golf club during the most recent inventory to the unique identifier received from each golf club during the previous inventory to determine which golf clubs have been recently removed from the group of golf clubs or returned to the group of golf clubs; monitoring a golf club that is absent from an inventory of golf clubs to determine if the absent golf club has been misplaced wherein the absent golf club is determined to be misplaced when a removal timer and a return timer have expired; and initiating an alert if one or more of the golf clubs are determined to be misplaced.

Numerous other advantages and features of the described embodiments will become readily apparent from the detailed description of preferred embodiments of the invention, from the claims and from accompanying drawings in which like numerals are employed to designate like parts throughout the same.

DETAILED DESCRIPTION OF THE INVENTION

Figure 1:
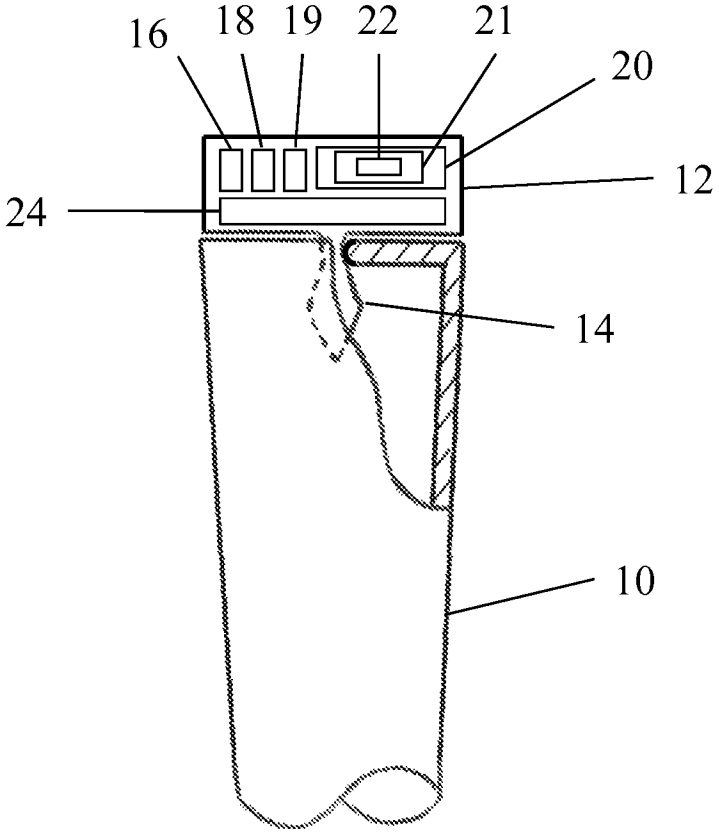
FIG. 1 is a partial cross-sectional view of the end of the grip portion of a golf club, showing the Peripheral Unit affixed within the hole at the end of the grip, where the Peripheral Unit comprises a radio frequency (RF) transmitter and receiver, a microprocessor, a motion sensor such as a 3-axis accelerometer, and a battery.

During a game of golf, a golfer will often remove more than one club from his golf bag, especially when his golf ball is close to the putting green. The clubs removed usually include one or more wedge clubs, as well as the putter club. After the golfer uses the wedge club(s) to hit the ball onto the green, the wedge club(s) is often placed on the ground while the golfer uses the putter club on the green. Sometimes, after putting, the golfer forgets to retrieve the wedge club(s) that he has left on the ground. The missing club(s) can go unnoticed for several holes, causing significant inconvenience, or can be lost entirely, causing both inconvenience and undesired monetary expenditure.

The present invention is a system for tracking movements of golf clubs and alerting a golfer when one or more golf clubs are misplaced from a group of golf clubs comprising a peripheral unit associated with each golf club of the group of clubs, a base unit in communication with each peripheral unit and an alarm that alerts the golfer when a golf club has been misplaced. The peripheral unit associated with each golf club is operative to transmit and detect signals throughout a limited range and has a memory operative to store and transmit a unique identifier. The base unit, generally associated with a golf bag, is operative to transmit and detect signals from each peripheral unit throughout a limited range, and has a memory operative to store one or more unique identifiers transmitted by the one or more peripheral units and a processor operative to perform an initial inventory of the group of golf clubs, store the initial inventory in the memory, initiate a removal timer for each club removed from the golf bag, initiate a return timer for each club to be returned to the golf bag, initiate a polling timer to periodically perform subsequent inventories of the group of golf clubs and compare the subsequent inventories to the initial inventory. A golf club may be identified as absent when the peripheral unit of the golf club is outside the limited range and its associated unique identifier is not received by the base unit. Or the system may identify a golf club as absent from the group of golf clubs if a motion sensor such as a 3-axis accelerometer in the peripheral unit of the golf club senses that the club has been removed from the golf bag. An absent club is determined to be misplaced when the removal timer and the return timer have expired. When a golf club has been determined to be misplaced an alarm operative to alert the golfer is initiated.

The system alerts a golfer after a relatively short period of time, for example before he proceeds to the next hole of the golf course that he has misplaced or left behind one or more golf clubs. In the context herein, it should be understood that a misplaced golf club is a golf club that has been lost, accidentally left behind, forgotten, or otherwise not returned to the golf bag or to close proximity to the golf bag due to circumstances other than the use of the golf club as part of normal golf play.

Other features and advantages will be apparent from the following description of various embodiments, which illustrate, by way of example, the principles of the disclosed systems, devices, and methods.

While the disclosed systems, devices, and methods are described with respect to golf clubs, the systems, devices, and methods may be adapted to be used in various applications known in the art. It should be understood that it is within the broadest scope of the present invention to cover any systems that rely upon the devices and methods described herein to track movement of items and alert a user that any type of item has been misplaced from its normal storage place.

The present disclosure is of a system that comprises a plurality of first devices attached to a plurality of golf clubs; these first devices shall be referred to hereinafter as "Peripheral Units". The system of the present disclosure further comprises a second device attached to, inherent to, embedded in, or otherwise associated with a golf bag; this second device shall be referred to hereinafter as a "Base Unit". The principles of operation of this system indicate that a minimum of two Peripheral Units are included in the system to achieve the misplaced club alert functionality.

I. Peripheral Unit

In one embodiment, each Peripheral Unit is attached to a golf club, and a single Peripheral Unit is attached to each golf club that is to be protected from loss. Furthermore, the principles of operation of this system indicate that a Peripheral Unit is attached to each golf club that may be commonly removed from the golf bag simultaneous to the removal of a different club that is to be protected from loss. For example, if a wedge club is to be protected from loss, a Peripheral Unit should be attached to that wedge club, and since the putter club is commonly removed from the golf bag simultaneous to the removal of the wedge club, a Peripheral Unit should be attached to that putter club as well. Each club with a Peripheral Unit will be accorded the same protection from loss, so in the example cited above, the putter club will automatically receive protection from loss just as the wedge club will. There exists no intrinsic upper limit to the number of Peripheral Units in use within the system, as long as each Peripheral Unit is attached to a separate golf club to be stored in a golf bag associated with the Base Unit.

One embodiment of the Peripheral Unit 12 is illustrated in FIG. 1, which also shows an exemplary manner of attachment of a Peripheral Unit 12 to a golf club. In the embodiment, the body of the Peripheral Unit 12 includes a piece 14 that is pushed, screwed, or otherwise inserted into the hole that is typically found at the end of the grip portion 10 of a typical golf club.

The body of the Peripheral Unit 12 includes an enclosure containing a Processing Segment 20, a radio-frequency (RF) transmitter 16, an RF receiver 18, a motion sensor such as a 3-axis accelerometer 19, an internal or external antenna, and an electrical power source such as a battery 24 (e.g. a CR1632 battery). The components in the Peripheral Unit 12 are connected to one another by techniques known in the art. The Processing Segment 20 includes a microcontroller 21 (which may be otherwise known as an integrated circuit, a controller, a processor, a microprocessor, or a microcomputer), as well as a digital memory device 22 which may be integrated to the microcontroller 21. The Processing Segment 20 performs various processing methods, such as processing incoming and outgoing signals, and may store various information that may be used for these methods. For example, in an embodiment a unique identifier code is associated with each Peripheral Unit 12, and that code is stored in the digital memory device 22 of the Peripheral Unit 12. The code is "unique" in the sense that no two Peripheral Units 12 in a single system contain the same codes.

One embodiment of the peripheral unit enclosure is illustrated in FIG. 6, FIG. 7, FIG. 8, and FIG. 9. This enclosure is a mechanical device to affix one or more components to a golf club, for example the components of the Peripheral Unit 12. It comprises a screw element 70 attached to the main body of the device. The screw element comprises a hub portion 72 and a spiral flight portion 74 extending around said hub in a generally helical path. Upon turning the device with the screw element in a hole 76 at the end of the grip portion 78 of a golf club 80, the flight portion engages the material of the grip portion to affix the device to the golf club. Other features are as follows: The surface 82 of the device that faces the golf club grip portion has a concave shape to accommodate a convex shape of the end of the golf club grip portion 78. The main body of the device 84 comprises a cavity 86 that may be used to contain one or more components that are to be affixed to a golf club. A cap 88 snaps or screws into the main body to secure and protect the one or more components contained in the cavity thereof.

II. Base Unit

Figure 2:
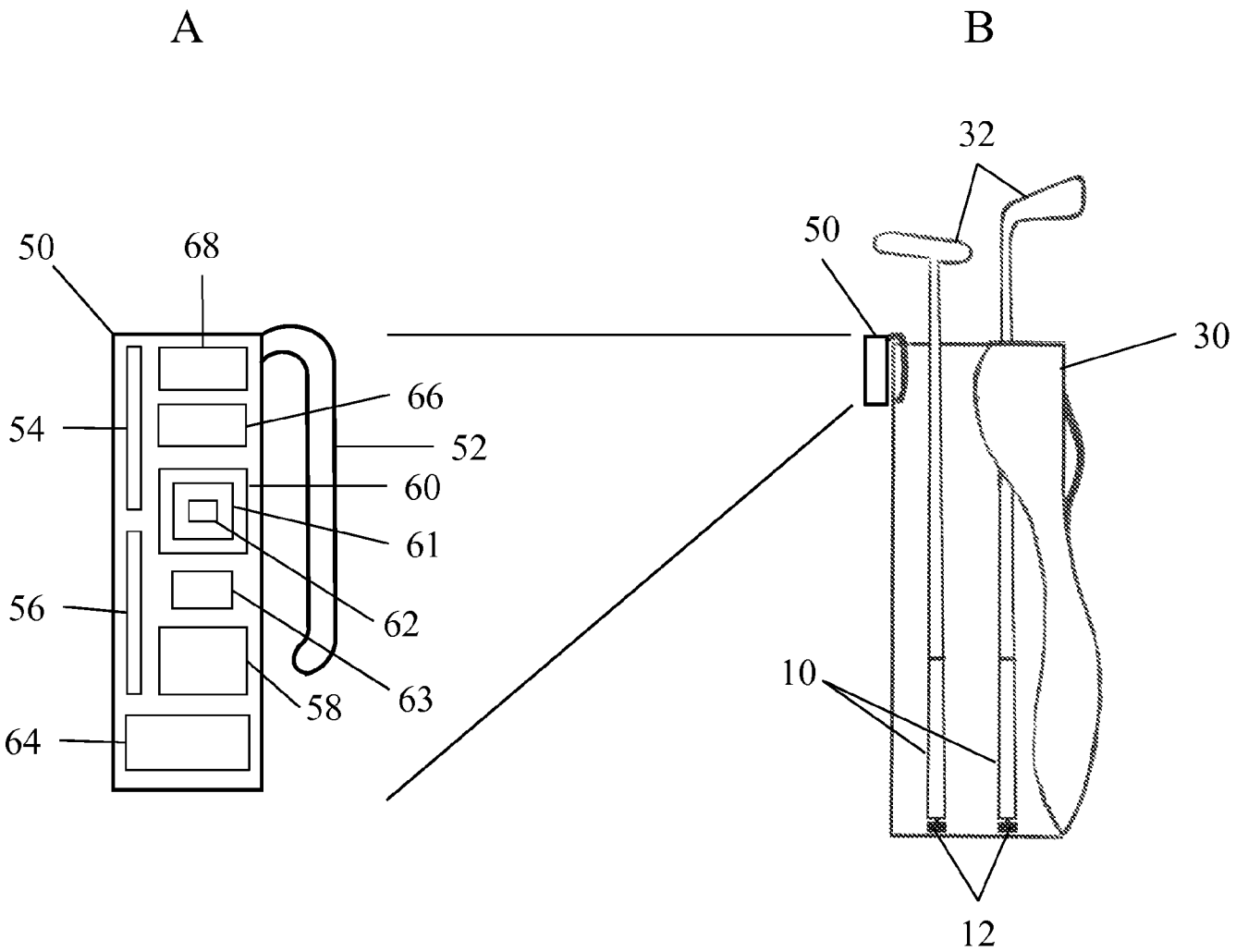
FIG. 2 is a partial cross-sectional view of a golf bag containing two golf clubs, each fitted with a Peripheral Unit of the type shown in FIG. 1 and a Base Unit clipped onto the top of the golf bag.

One embodiment of the Base Unit 50 is illustrated in FIG. 2, which also shows an exemplary manner of attachment of a Base Unit 50 to a golf bag 30. In the embodiment, the body of the Base Unit 50 is similar in size and shape to the size and shape of a pager, and includes a mechanism such as a clip 52 allowing it to be attached to the golf bag 30. FIG. 2 also shows two golf clubs 32 in the golf bag 30, with a Peripheral Unit 12 attached to each.

The body of the Base Unit 50 includes an enclosure containing a Processing Segment 60, an RF transmitter 68, an RF receiver 66, an internal or external antenna, an electrical power source such as a battery 58 (e.g. two triple-A batteries), a motion sensor 63, an alarm mechanism 64, a visual display 54, a means for user input such as a key pad 56 which may include a switch to power on or power off the Base Unit's electronics. The components in the Base Unit 50 are connected to one another by techniques known in the art. The Processing Segment 60 includes a microcontroller 61 (which may be otherwise known as an integrated circuit, a controller, a processor, a microprocessor, or a microcomputer), as well as a digital memory device 62 which may be integrated to the microcontroller 61. The Processing Segment 60 performs various processing methods, such as processing incoming and outgoing signals, and may store various information that may be used for these methods.

The alarm mechanism 64 may be any combination of: a) one or more visible alerting component(s) emitting light, such as light emitting diodes (LEDs); b) an audible alerting component emitting sound such as beeps, simulated voices, music, or other audible tones; and/or c) a vibrating component causing vibrations that can be perceived by the user.

In an embodiment the memory 62 within the Base Unit 50 is programmed with all of the unique identifier codes associated with all of the Peripheral Units 12 in the system of which the Base Unit 50 is a part. Periodically, with a temporal period of predetermined length, typically some fraction of a minute such as twenty-five seconds, the Base Unit 50 performs a poll of the Peripheral Units 12 to obtain an inventory of the clubs 32 present in the bag 30 or in close proximity to the bag 30. This poll is controlled by the Processing Segment 60 of the Base Unit 50, and is performed by sequentially transmitting RF signals from the transmitter 68 of the Base Unit 50, each signal encoded with one of the unique identifier codes associated with the Peripheral Units 12.

When a first signal transmitted by the Base Unit 50 is received by the receiver 18 of a Peripheral Unit 12, this first signal is processed by the Processing Segment 20 of the Peripheral Unit 12. If the identifier code encoded into this first signal matches the identifier code stored in the digital memory device 22 of the Peripheral Unit 12, the Peripheral Unit 12 transmits a second signal. The second signal is controlled by the Processing Segment 20 of the Peripheral Unit 12 and is encoded with the identifier code of the Peripheral Unit 12 and is transmitted by the transmitter 16 of the Peripheral Unit 12.

Subsequent to sending each signal of a poll, the Base Unit 50 waits a predetermined amount of time, typically some fraction of a second, to receive a signal from the Peripheral Unit 12 with associated identifier code matching the identifier code encoded into the signal sent by the Base Unit 50. If the receiver 66 of the Base Unit 50 does not receive such a signal from that particular Peripheral Unit 12 within the wait time, the Processing Segment 60 of the Base Unit 50 does not count that particular Peripheral Unit 12 nor its associated golf club 32 in the current inventory. However, if the receiver 66 of the Base Unit 50 does receive such a signal from that particular Peripheral Unit 12 within the wait time, the Processing Segment 60 of the Base Unit 50 does count that particular Peripheral Unit 12 and its associated golf club 32 in the current inventory. In this embodiment, the RF communication method may be designed such that the RF signal from a particular Peripheral Unit 12 will be received by the Base Unit 50 only if that particular Peripheral Unit 12 is in close proximity to the Base Unit 50. In the context herein, "close proximity" should be understood to mean within a distance indicating that a golf club 32 is in the golf bag 30, or more generally that a golf club 32 is not in use. For example, close proximity means within approximately 10 feet of the Base Unit 50. In some embodiments, this distance threshold within which the RF signal from a Peripheral Unit 12 will be received by the Base Unit 50 may be greater than 10 feet, for example it may be 15 feet, or the distance threshold may be less than 10 feet, for example it may be 5 feet.

In an embodiment, when the Base Unit 50 receives an RF signal from a particular Peripheral Unit 12, a processing method implemented in the Processing Segment 60 of the Base Unit 50 may ascertain the magnitude (e.g. the voltage) of that signal as it comes from the receiver 66. The Processing Segment 60 of the Base Unit 50 then only counts a Peripheral Unit 12 and its associated golf club 32 in the current inventory if the received magnitude of the signal sent by that Peripheral Unit 12 is above a predetermined threshold, and does not count a Peripheral Unit 12 nor its associated golf club 32 in the current inventory if the received magnitude of the signal sent by that Peripheral Unit 12 is below the predetermined threshold. In this embodiment, the RF communication method may be designed such that the RF signal from a particular Peripheral Unit 12 will be received by the Base Unit 50 even if that particular Peripheral Unit 12 is not in close proximity to the Base Unit 50.

III. Method for Detecting Misplaced Golf Club

In one embodiment, the Processing Segment 60 of the Base Unit 50 receives periodic inputs consisting of an inventory of golf clubs 32 that are currently in the bag 30 or in very close proximity to the bag 30. These inputs are used in a processing method of logic within the Processing Segment 60 of the Base Unit 50 to monitor the sequence and timing of removal and return of the golf clubs 32, and to determine when a club has been misplaced, and to then activate an alarm 64 to notify the golfer. In this embodiment, these inputs include particular identifier codes associated with particular clubs, so that the processing method can distinguish between different clubs.

The processing method compares the most recent inventory to the previous inventory. Any particular club present in the most recent inventory that was absent in the previous inventory is considered by the method to have been returned to the bag 30. Any particular club absent in the most recent inventory that was present in the previous inventory is considered by the method to have been removed from the bag 30. The method is able to employ multiple simultaneous timers of various durations, which may be activated at different times and decremented simultaneously and individually. The method employs a single timer called the Polling Timer that dictates the frequency with which the Peripheral Units 12 and the Base Unit 50 communicate with each other, and thus the frequency with which the Base Unit's method obtains an inventory of golf clubs 32. The duration of the polling timer may be for example 25 seconds. Decreasing the duration of the polling timer would cause more frequent polling, which in some cases would decrease the amount of time within which the system alerts the golfer to a misplaced golf club, but it would also cause the system to consume increased electrical energy.

For each golf club 32 that is being monitored by the Base Unit 50, there is a separate timer within the processing method called a Max Timer. Whenever the processing method determines that a particular club has been removed, the Max Timer associated with that club is reset and activated. If any Max Timer expires, the Base Unit's alarm 64 is activated.

This provision of the method ensures that if any golf club is out of close proximity to the golf bag 30 for a time greater than the duration of the Max Timer, the alarm 64 will be activated to notify the golfer. In order to prevent false alarms, the Max Timer has duration greater than the amount of time that any given club may typically be out of close proximity to the golf bag 30 during normal play when that club has not been misplaced, for example 500 seconds. However, it may be generally desirable to alert the golfer to a misplaced club in an amount of time significantly shorter than the Max Timer, so other provisions are present in the method to achieve this goal, with the Max Timer functionality left as a back-up measure.

The processing method also employs a single timer called the Removal Timer, which has a shorter duration than the Max Timer, for example 30 seconds. Whenever the method determines that any club 32 has been removed from the bag 30, the Removal Timer is reset and activated. If the Removal Timer expires while it is active, then the method considers all clubs that are out of the bag 30 to be in use.

The processing method also employs a single timer called the Return Timer, which has a shorter duration than the Max Timer, for example 30 seconds. Whenever the method determines that any club 32 has been returned to the bag 30, the Return Timer is reset and activated. However, this functionality is blocked if the Removal Timer is active; the Return Timer will not be activated while the Removal Timer is active, and if the Return Timer is active when the Removal Timer is activated, the Return Timer will then be deactivated.

If the Return Timer expires while it is active, and there are at that time one or more clubs in use, the alarm 64 will be activated to notify the golfer that one or more clubs have been misplaced.

In an exemplary scenario, if two clubs A and B are removed from the bag 30 for longer than the duration of the Removal Timer and then at some later time only club A is returned to the bag 30, then when the next inventory is obtained, the Return Timer will be activated, and if it expires while the club B is still not in close proximity to the bag 30, the alarm 64 will be activated.

In another exemplary scenario, if there are two clubs, A and B in use, but then the golfer decides to switch club B for club C, which is in the bag 30, the Return Timer will not be active after the exchange, either because if club C is removed shortly before club B is returned, the Removal Timer activated by club C's removal prevents the Return Timer from activating upon club B's return, or if club B is returned shortly before club C is removed, the Return Timer activated upon club B's return is deactivated by the Removal Timer activated by club C's removal. Thus, as desired, the alarm 64 is not activated in this scenario of normal play.

Also, whenever the Removal Timer expires, the method checks whether that instance of the Removal Timer has deactivated or inhibited a Return Timer. If it has, the method checks whether any clubs are in use that were not in use before the Removal Timer started. If not, the Return Timer is started. Thus, in the exemplary scenario described above, after club B, which is in use, is exchanged for club C, which is in the bag 30, the Return Timer for club B's return is either inhibited or deactivated by the Removal Timer for club C's removal. In this case there is a club (C) in use that was not in use before the Removal Timer started, and so the Return Timer is not started. However, in another scenario wherein there are two clubs, A and B in use, the golfer returns only club A to the bag 30, activating the Return Timer. Before the Return Timer expires, the golfer removes a club from the bag 30, starting the Removal Timer and deactivating the Return Timer, but then returns that same club to the bag 30. Then when the Removal Timer expires, the method will find that the Removal Timer had deactivated a Return Timer, and since there is not a club in use that was not in use before the Removal Timer started, the Return Timer will be started. When that Return Timer expires, the alarm 64 will be activated, as desired, to notify the golfer that Club B has been misplaced.

Figure 5:
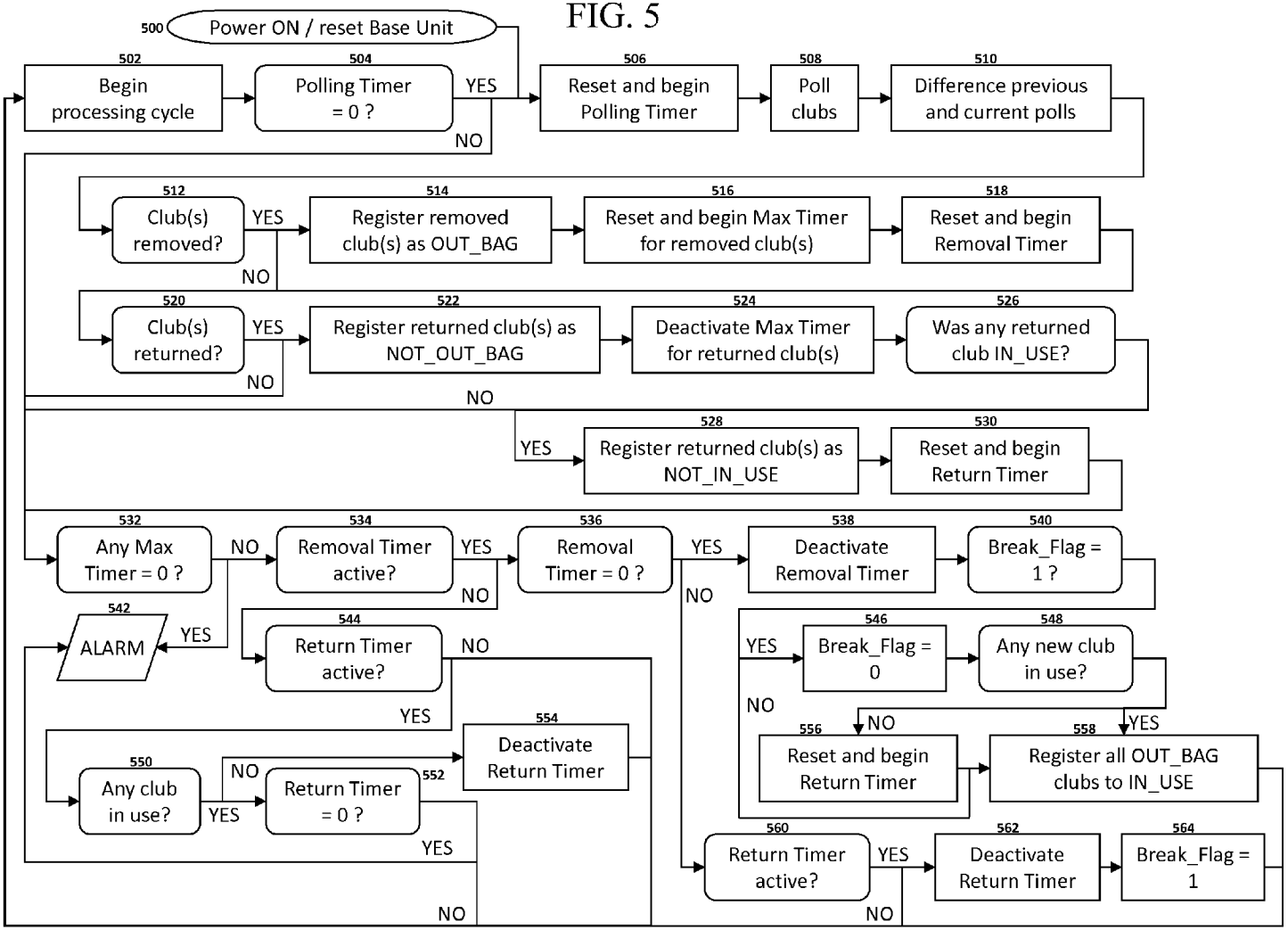
FIG. 5 is a flowchart representing aspects of an exemplary processing method of logic implemented in the Base Unit.
Figure 6:
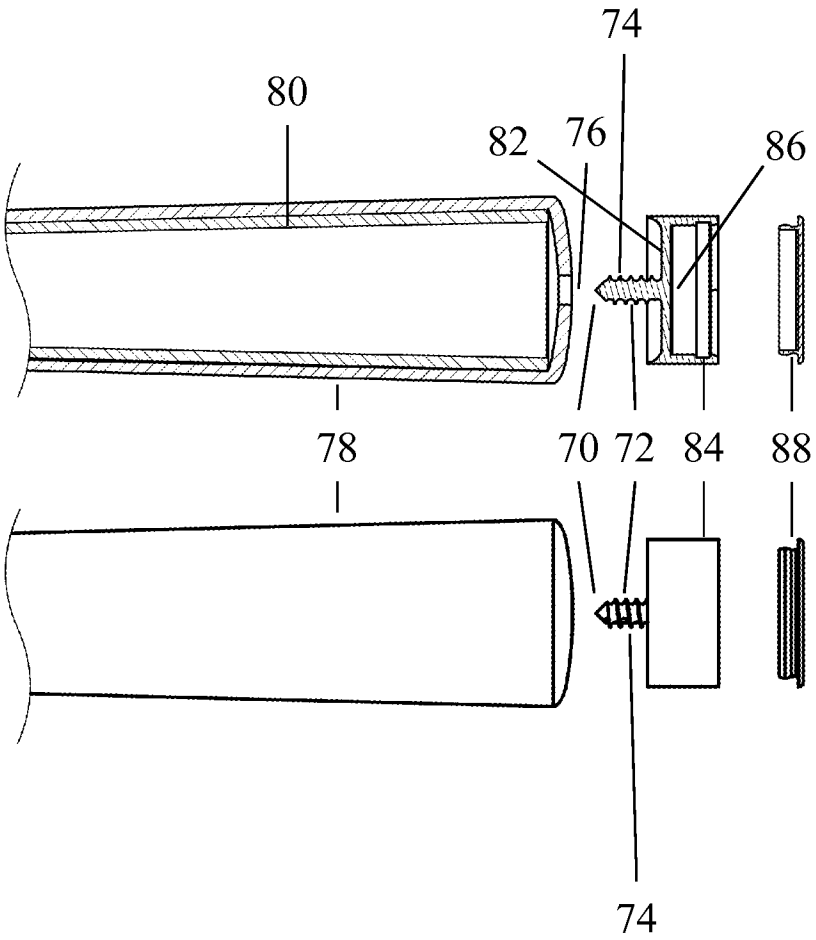
FIG. 6 is a solid exploded view and a cross-sectional exploded view of an exemplary mechanical device that serves as an enclosure for the other components of the Peripheral Unit, and may be affixed to the grip portion of a golf club by a screw portion of the device that screws into a hole at the end of the grip portion.
Figure 7:
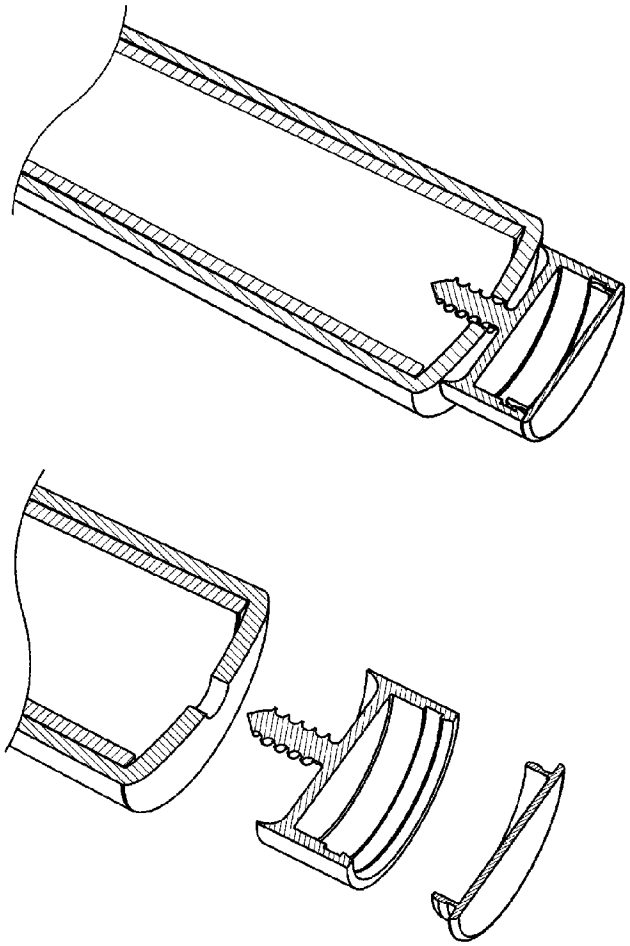
FIG. 7 and FIG. 8 are cross-sectional views and cross-sectional exploded views of said enclosure device.
Figure 8:
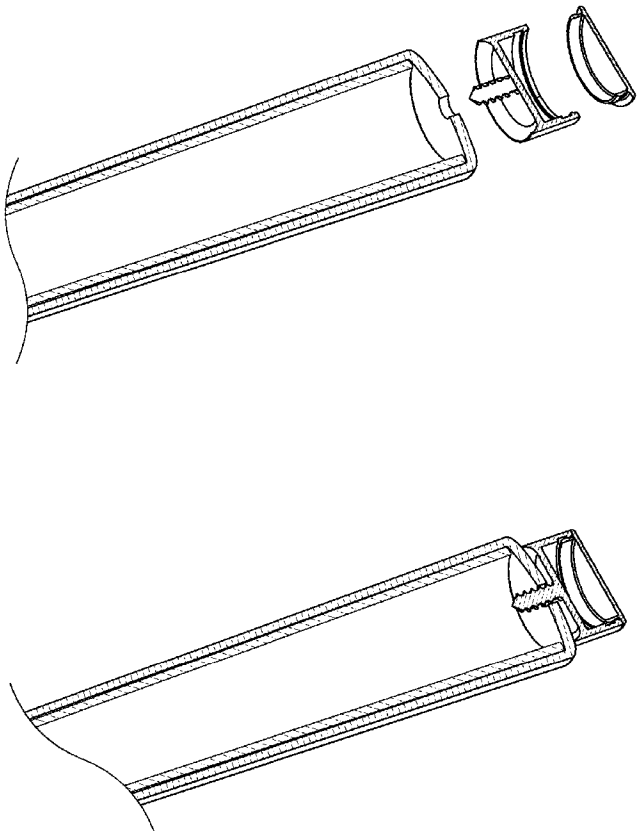
Figure 9:
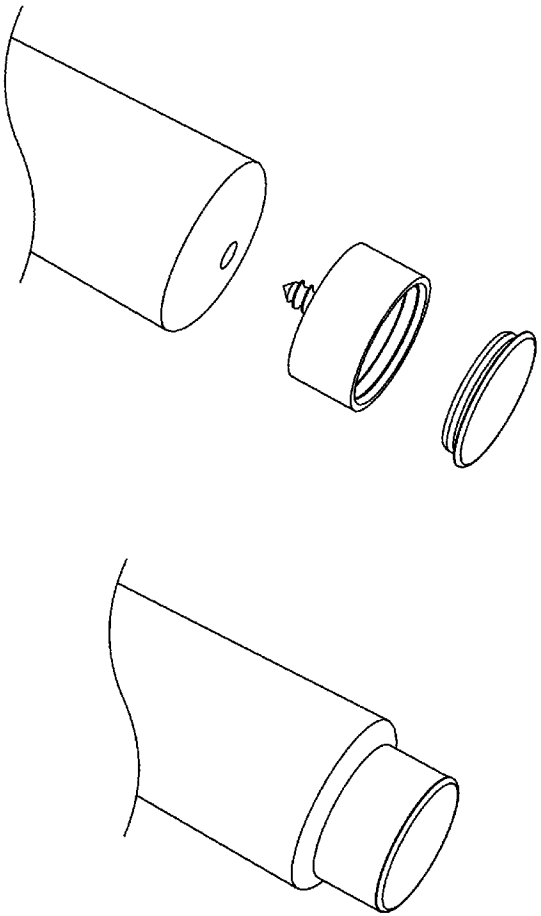
FIG. 9 is a solid view and a solid exploded view of said enclosure device.

FIG. 5 shows a flow diagram representing an exemplary processing method of logic within the Processing Segment 60 of the Base Unit 50. The processing is performed in discrete cycles, with an entire cycle executed at each time step. For example, an entire cycle may be executed once per second.

When the Base Unit 50 is either powered on or reset in step 500, the method goes to step 506.

At step 502, the Base Unit's method begins its first processing cycle by proceeding to decision step 504.

Timers that may be activated within the method are: the Removal Timer, the Return Timer, and the Max Timer. (The durations of the Removal Timer and the Return Timer may be, for example, 30 seconds each. The duration of the Max Timer is significantly higher than that of the Removal and Return Timers; for example, the duration of the Max Timer may be 500 seconds.) There is actually a separate independent Max Timer for each golf club that is part of the system, i.e. for each club fitted with a Peripheral Unit 12. There is also a timer that is always active: the Polling Timer. (The duration of the Polling Timer should be somewhat lower than that of the Removal and Return Timers; for example, the duration of the Polling Timer may be 25 seconds.)

At decision step 504, if the Polling Timer=0 (i.e. has just expired), the Polling Timer is reset to its full duration in step 506 and resumes counting down, followed by step 508; otherwise the method goes to decision step 532.

In step 508, the clubs are polled via a method of RF communication, such that the Base Unit 50 obtains an inventory of which clubs are currently in the golf bag or in close proximity to the golf bag, and the method progresses to step 510.

In step 510, the method ascertains the difference between the current inventory and the previous inventory. Any club that is missing from the current inventory but was present in the previous inventory is considered to have been removed from the bag between the times of the previous and current polling. Any club that is present in the current inventory but was missing from the previous inventory is considered to have been returned to the bag between the times of the previous and current polling. After step 510 the method progresses to decision step 512.

At decision step 512, if there were one or more clubs removed between the times of the previous and current polling, in step 514 those clubs are registered as having status OUT_BAG, followed by step 516; otherwise the method goes to decision step 520.

In step 516, the Max Timer is set to its full duration and begins counting down, and the method progresses to step 518.

In step 518, the Removal Timer is set to its full duration and begins counting down, and the method progresses to decision step 520.

At decision step 520, if there were one or more clubs returned between the times of the previous and current polling, in step 522 those clubs are registered as having status NOT_OUT_BAG, followed by step 524; otherwise the method goes to decision step 532.

In step 524, the Max Timers for any returned clubs are deactivated, and the method progresses to decision step 526.

At decision step 526, if any of the returned clubs is designated within the method as IN_USE, in step 528 the returned clubs are registered as NOT_IN_USE, followed by step 530; otherwise the method goes to decision step 532.

In step 530, the Return Timer is set to its full duration, and begins counting down, and the method progresses to decision step 532.

At decision step 532, if the Max Timer=0 (i.e. has just expired) for any club, the Base Unit's alarm is activated in step 542 to alert the user that he has misplaced one or more golf clubs; otherwise the method goes to decision step 534.

At decision step 534, if the Removal timer is active, the method goes to decision step 536; otherwise the method goes to decision step 544.

At decision step 536, if the Removal Timer=0 (i.e. has just expired), the Removal Timer is deactivated in step 538, followed by decision step 540; otherwise the method goes to decision step 560.

There is a variable in the method called Break_Flag, which can be set to either 0 or 1. At decision step 540, if Break_Flag=1, Break_Flag is set to 0 in step 546; otherwise the method goes to step 558.

At decision step 548, if any of the clubs designated as OUT_BAG are not already designated as IN_USE (meaning effectively that there are one or more new clubs in use), the method goes to step 558; otherwise in step 556, the Return Timer is set to its full duration and begins counting down, and the method progresses to step 558.

In step 558, all clubs designated as OUT_BAG are registered as IN_USE, and the method is then complete until the start of the next processing cycle.

At decision step 560, if the Return Timer is active, the Return Timer is deactivated in step 562, followed by step 564; otherwise the method is complete until the start of the next processing cycle.

In step 564, Break_Flag is set to 1, and the method is then complete until the start of the next processing cycle.

At decision step 544, if the Return Timer is active, the method goes to decision step 550; otherwise the method is complete until the start of the next processing cycle.

At decision step 550, if one or more clubs is designated as IN_USE, the method goes to decision step 552; otherwise the method goes to step 554.

At decision step 552, if the Return Timer=0 (i.e. has just expired), the Base Unit's alarm is activated in step 542 to alert the user that he has misplaced one or more golf clubs; otherwise the method is complete until the start of the next processing cycle.

In step 554, the Return Timer is deactivated, and the method is then complete until the start of the next processing cycle.

IV. Operation

It is important to note that the system of the present disclosure is easy for the user to implement, is not cumbersome to use and does not impede or alter the normal style of golf play.

A typical system may be sold in some type of packaging known in the art. To begin using the system, one removes the system from the packaging. A typical system includes a single Base Unit 50 and a plurality of Peripheral Units 12. For example, a system may include three Peripheral Units 12.

One may insert a battery 58, rechargeable or not, into the Base Unit 50. A typical battery 58 for the Base Unit 50 is a pair of triple-A batteries, but other types of batteries may be used as well. The battery 58 for the Base Unit 50 may be included in the packaging with the system, or may be purchased separately.

One may insert a battery 24, rechargeable or not, into each Peripheral Unit 12. A typical battery for the Peripheral Unit 12 is one of a type known as coin-cell batteries. The batteries for the Peripheral Units 12 may be included in the packaging with the system, or may be purchased separately. The system may be sold with the batteries for the Peripheral Units 12 already in place in the Peripheral Units 12. In this case, there may be a way to activate each Peripheral Units 12 by connecting its battery 24 to its electronics. For example, one may pull out a plastic tab that was theretofore electrically insulating the battery 24 from the electronics of the Peripheral Unit 12. Alternatively, one may twist one part of the Peripheral Unit 12 relative to another part, such that the battery 24 becomes electrically connected to the electronics of the Peripheral Unit 12 where it was not before.

One may then attach the Base Unit 50 to one's golf bag 30 by way of some type of clip 52, hook and loop fasteners, or some other manner known in the art.

One may then attach each Peripheral Unit 12 to a golf club 32 by pushing, screwing, or otherwise inserting a piece 14 of the body of the Peripheral Unit 12 into the hole typically found at the end of the grip portion 10 of a golf club 32. In the unlikely case that there is not a hole at the end of the grip portion 10 of a golf club, a hole may be made with an awl, drill, or some other device commonly available.

One would typically attach the Peripheral Units 12 to wedge clubs, as these clubs are typically left behind on the golf course, as discussed above. For example, one would typically attach a Peripheral Unit 12 to each of the sand wedge and the pitching wedge. Also, one would typically attach a Peripheral Unit 12 to the putter club, because the putter is commonly removed from the golf bag 30 simultaneous to the removal of the wedge clubs, as discussed above.

In one embodiment, when one is ready to begin playing golf, one turns on the power switch of the Base Unit 50 to provide power to the electronics of the Base Unit 50, and thus to cause the system to be ready for use. In another embodiment, the Base Unit 50 includes means to automatically turn itself on.

At this point in the use of the system, no special actions are necessary by the user. A major advantage of this system is that it can be said to be transparent to the user, that is, one does not have to think about the system or alter one's normal mode of golf play in order for the system to function properly.

The system will now monitor the sequence and timing of golf clubs 32 being removed from and returned to the golf bag 30, and will alert the user with an alarm 64 when it detects that a club has been misplaced. The user will thereby be spared annoyance, embarrassment, delay, and cost.

V. Features and Functionality of the Processing Segments

In one embodiment, the Base Unit 50 performs a poll by having its Processing Segment 60 generate a data packet comprising a preamble, an identifier code, a command, and a checksum, which are types of data elements known in the art. That data packet is then used to modulate a carrier frequency, for example a 433 MHz carrier frequency, creating a signal that is then transmitted by the transmitter 68 of the Base Unit 50.

In one embodiment, the Peripheral Unit 12 usually remains in a low-power "listening" mode. To conserve electrical power, when the Peripheral Unit 12 is in listening mode, its microcontroller 21 is in "sleep" mode. In this embodiment, the receiver 18 draws very little electrical power and remains active while the Peripheral Unit 12 is in listening mode. When the Peripheral Unit 12 receives an RF signal from the Base Unit 50, the receiver detects whether the identifier code encoded into that signal matches the identifier code stored in the memory 22 of the Peripheral Unit 12. If so, the receiver activates the microcontroller 21 of the Peripheral Unit 12, taking it out of sleep mode. Then the receiver passes the demodulated data of the signal to the microcontroller 21 for processing.

In the case that the signal received by the Processing Segment 20 of a Peripheral Unit 12 contains a polling command, that Processing Segment 20 generates a data packet comprising a preamble, the identifier code stored in the memory 22 of the Peripheral Unit 12, a value to indicate the voltage level of the battery 24 in the Peripheral Unit 12, and a checksum. That data packet is then used to modulate a carrier frequency, for example a 433 MHz carrier frequency, creating a signal that is then transmitted by the transmitter 16 of the Peripheral Unit 12.

When the receiver 66 of the Base Unit 50 receives such a signal from a Peripheral Unit 12, the signal may be amplified, mixed with a Local Oscillator, filtered, demodulated, and presented to the microcontroller 61 of the Base Unit 50 for processing. Processing may include obtaining an inventory of Peripheral Units 12 and associated golf clubs 32 that are in the golf bag 30 or in close proximity to the golf bag 30.

VI. Additional Embodiments and Features of the System

Figure 3:
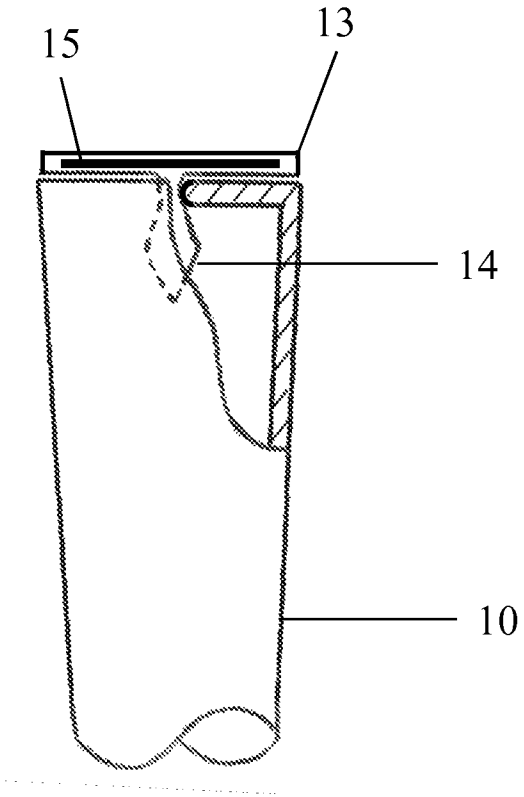
FIG. 3 is a partial cross-sectional view of the end of the grip portion of a golf club, showing the Peripheral unit affixed within the hole at the end of the grip, where the Peripheral Unit comprises a passive radio frequency identification (RFID) tag.
Figure 4:
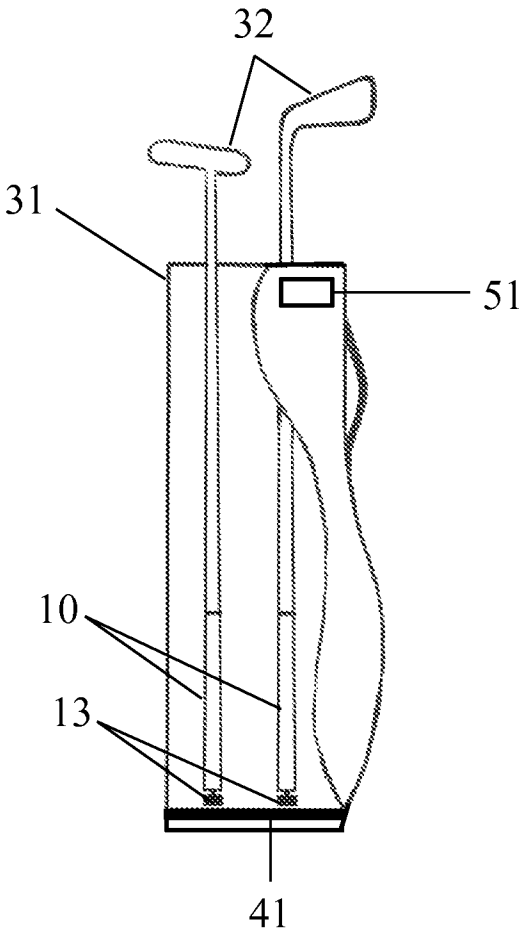
FIG. 4 is a partial cross-sectional view of a golf bag containing two golf clubs, each fitted with a Peripheral Unit of the type shown in FIG. 3, and a built-in RFID-type Base Unit.

In another embodiment, each Peripheral Unit 13 contains a passive radio frequency identification (RFID) tag 15 as shown in FIG. 3. In this embodiment the Peripheral Unit 13 does not contain a Processing Segment or an inherent battery or other power source. In this embodiment the Base Unit 51 contains an RF transmitter and an RF receiver, which taken together and configured to communicate with a passive RFID tag may be called an RFID Reader. In this embodiment, the method of communication between the Base Unit 51 and a Peripheral Unit 13 comprises RF signals transmitted by the Base Unit 51, which when incident upon an RFID tag 15 produce backscatter RF energy, which is modulated by the RFID tag 15 via techniques known in the art, such that the backscatter RF energy forms an RF signal that may be received by the Base Unit 51 if it is in close proximity to the Peripheral Unit 13. The RFID tag 15 includes a digital memory device upon which is stored an identifier code which is included on the signal produced by the RFID tag 15 and received by the Base Unit 51. Thus the Base Unit 51 may use a similar processing method as that described above and shown in FIG. 5 to obtain inventories of golf clubs 32 and detect when one has been misplaced and activate an alarm 64 appropriately. In this embodiment, it is helpful for an RF antenna 41 connected to the RFID Reader to be in very close proximity to the RFID tags of the Peripheral Units 13 when the golf clubs 32 are in their normal positions in the golf bag 31, for example within a distance of one foot. Therefore, a typical form of the passive RFID system implementation is as shown in FIG. 4, wherein the Base Unit 51 is built into the golf bag 31 as a feature of the golf bag 31, instead of being a separate unit that is attached to the golf bag 31. Then the antenna 41 connected to the RFID reader is embedded in or near the bottom surface of the golf bag 31, such that the Peripheral Units 13 rest very close to the antenna 41 when the clubs 32 are in the bag 30, for example within a distance of one foot.

In another embodiment, the Polling Timer is implemented in the Processing Segment 20 of each Peripheral Unit 12, and according to the Polling Timer, each Peripheral Unit 12 periodically transmits a signal encoded with the identifier code stored in the memory 22 of the Peripheral Unit 12. The Base Unit 50 will receive such a signal from a Peripheral Unit 12 if the associated golf club 32 is in the golf bag 30 or in close proximity to the golf bag 30. Thus the Base Unit 50 may use a similar processing method as that described above and shown in FIG. 5 to obtain inventories of golf clubs 32 and detect when one has been misplaced and activate an alarm 64 appropriately. In this embodiment, the Base Unit 50 may or may not include an RF transmitter, and each Peripheral Unit 12 may or may not include an RF receiver.

In FIG. 2, the attachment manner for the Base Unit 50 is provided by a feature 52 that hooks or clips to the top or side of the golf bag 30. Possible variations of this embodiment include location of the Base Unit 50 in a pocket of the golf bag 30, or in or on a golf cart, or in some other location in close proximity to the golf bag 30. In an embodiment wherein the Base Unit 50 is located in or on the golf cart, the Base Unit 50 may be attached to the cart via suction cup, clamp, magnet or some other attachment manner known in the art. It may be desirable to locate and attach the Base Unit 50 in a manner that gives a minimally obstructed line-of-sight between the Base Unit 50 and the Peripheral Units 12 when the golf clubs 32 are in the golf bag 30, and/or maintains some orientation that facilitates optimal RF transmission between the Base Unit 50 and the Peripheral Units 12.

In addition to components described heretofore, the Base Unit 50 may include any or all of the following: a means of powering on and off; a means of resetting its processing method; a protective housing or enclosure; selectable varieties of alert modes for the alarm 64; a display device 54 for displaying various system information; a key pad 56, buttons, or other means of setting various variables or other parameters of the processing method and otherwise controlling the functionality of the system. The Base Unit 50 may have as a power source a rechargeable battery, and in this case, the Base Unit 50 may include components to allow connection to an external electrical power source for charging of that battery. The Peripheral Units 12 may have as power sources rechargeable batteries, and in this case, the Base Unit 50 may include components to allow connection to the Peripheral Units 12 and to an external electrical power source for charging of those batteries.

The electrical power sources for the Base Unit 50 and/or Peripheral Units 12 may comprise photo-voltaic cell arrays, and/or batteries of some type that are charged and/or augmented by photo-voltaic cell arrays.

The Base Unit 50 may be electrically powered on and off via an automatic method requiring no user input, controlled by the Processing Segment 60 of the Base Unit 50, and employing a light sensor and/or a motion sensor included in the Base Unit 50.

The Base Unit 50 may include a selection means such as a key pad 56 that allows the user to select the durations of the Max Timers, and/or the Polling Timer, and/or the Removal Timer, and/or the Return Timer.

The Base Unit 50 may include a display device 54 that is a Liquid Crystal Display (LCD), or an Organic Light-Emitting Diode (OLED) display.

The Base Unit 50 may include a display device 54 that indicates the number of clubs 32 that are currently out of the bag 30 or in use, the state of charge of its internal battery 58, and may include an alert mechanism that indicates a low state of charge of its internal battery 58.

The Base Unit 50 may include a display device 54 that indicates the state of charge of the batteries 24 in the Peripheral Units 12, and may include an alert mechanism that indicates a low state of charge of one or more batteries 24 of the Peripheral Units 12. In this embodiment, each Peripheral Unit 12 includes information regarding its battery's state of charge as part of the RF signals that it transmits to the Base Unit 50.

Further, each Peripheral Unit 12 may be built in to a special golf club grip, where the manner of attaching the Peripheral Unit 12 to a golf club is to attach that special grip to the golf club.

Further still, each Peripheral Unit 12 may include a light emitting diode (LED) or some other alert mechanism that indicates a low state of charge of its internal battery 24.

In another embodiment, a mobile telephone (a so-called Smart Phone, e.g. an iPhone, or an Android based phone, or a Windows based phone) may serve as the Base Unit. In this embodiment, the Peripheral Units may feature radio frequency (RF) system architecture that is compatible with the native RF capabilities of the mobile telephone. For example the Peripheral Units may employ Bluetooth RF architecture, and more specifically for example may feature Bluetooth Low Energy (BLE) RF architecture. In this embodiment, all Base Unit functionality is performed by the hardware and software of said mobile telephone, that functionality including the RF transmission and/or reception, the processing method of logic, the visual and/or audible alerts to the user, the visual display, the user input mechanism, other aspects of the user interface, and other aspects of the methods and systems described heretofore. In this embodiment, the functionality of the mobile telephone as a Base Unit may be enabled by a software application on the telephone known as an "app".

In this embodiment, the user interface on the mobile telephone may allow selection between two modes of functionality. In one mode, which may be called "Bag Mode", the telephone is meant to stay with the golf bag during golf play, for example in a pocket of the golf bag, and in this mode, the processing method of logic may be similar to that shown in FIG. 5.

In the second mode, which may be called "Pocket Mode", the telephone is meant to stay with the golfer, for example in his pants pocket, and in this mode, the processing method of logic may be different than that shown in FIG. 5. For example, for Pocket Mode, there may be a particular Peripheral Unit affixed directly to the golf bag in some manner, and registered uniquely with the Base Unit, in this case a mobile telephone. This Peripheral Unit affixed to the bag would allow the processing method of logic to detect whether the Base Unit is in close proximity to the golf bag. This information may enable various functionality. For example, in the Pocket Mode regime, if the Base Unit and by implication the user are in close proximity to the bag, but a particular Peripheral Unit and corresponding club are not in close proximity, the processing method of logic may infer that club to be misplaced, and may alert the user via one of the mechanisms of the mobile telephone.

In another embodiment, the system may identify a golf club as absent from the group of golf clubs if a motion sensor such as a 3-axis accelerometer 19 in the peripheral unit of the golf club senses that the club has been removed from the golf bag. In this embodiment, the different modes described above such as "Bag Mode" and "Pocket Mode" may not be necessary regardless of whether the base unit may be a mobile telephone and whether the base unit is located with the golfer or with the golf bag, and the processing method of logic may be similar to that shown in FIG. 5.

In yet another embodiment, a product containing a GPS device may serve as the base unit, where that product is other than a mobile telephone. Such products are commonly used by golfers to ascertain their own location relative to various relevant features of the golf course, such that they may choose which clubs to use and plan other aspects of their play accordingly. To serve as the base unit for the club tracking system, such a product may require an additional RF component beyond its standard design. However, the display screen, input buttons, processing segment, and power source may be shared by the club tracking system with the product's standard functionality and may be the same as would be contained in the product if it were not serving as a base unit.

In yet another embodiment, the base unit is not itself a mobile telephone, but it is operative to communicate with a mobile telephone via RF signals for example BLE signals.

In yet another embodiment, the base unit is not itself a product containing a GPS device, but it is operative to communicate with a separate product containing a GPS device.

VII. Additional Functionality of the System

In one embodiment of the invention each peripheral unit is paired with the base unit so that the memory in the base unit contains all of the unique identifier codes of the peripheral units. In an extension of this embodiment, the pairing entails a unique identifier code associated with the base unit being stored in the memory of each peripheral unit.

Pairing between the peripheral units and the base unit may provide anti-conflict functionality such that multiple systems of multiple users in close proximity do not cause RF or processing interference with each other.

An exemplary procedure sequence for pairing a new peripheral unit is as follows:

(Pairing only happens on power up of Peripheral Unit.)

1. Place battery in Peripheral Unit
   a) New Peripheral Unit begins 'config device' ping
   b) New Peripheral Unit shows slow LED flash
   c) New Peripheral Unit ping is detected by Base Unit
2. Select club from Base Unit user interface menu to pair new Peripheral Unit with Base Unit
   a) Base Unit sends 'config confirm' to new Peripheral Unit
   b) New Peripheral Unit stops LED flash & saves configuration
   c) New Peripheral Unit is configured as selected club An exemplary procedure sequence for peripheral unit reconfiguration is as follows:

1. Delete selected (old) club from the Base Unit
2. Power cycle the Peripheral Unit
   a) Pull and replace battery
3. Configure Peripheral Unit as for 'New Peripheral Unit Pairing Procedure'

In another embodiment, the pairing process includes opportunity for the user to input to the Base Unit via buttons or some other input mechanism names and/or labels corresponding to the Peripheral Units, which names and/or labels may for example represent the golf clubs to which the respective Peripheral Units are attached. In this embodiment, the Base Unit can employ these names and/or labels when displaying which clubs are in or out of the bag, which club(s) have been left behind, battery levels or low battery alerts for Peripheral Units, or other information specific to particular Peripheral Units and/or golf clubs.

In yet another embodiment, the Base Unit and each Peripheral Units contain motion sensing components 19 and 63 respectively. This feature enables a wide range of functionality which may be implemented in this embodiment, for example the following:

In an extension of the embodiment described herein previously wherein the Polling Timer is implemented by the Peripheral Unit, the Peripheral Unit may commence a series of RF transmissions upon sensing motion. The transmissions may be spaced with temporal periodicity corresponding to the Polling Timer. However, in this embodiment, the transmissions may cease after a certain pre-defined number of transmissions have been sent subsequent to the last sensed motion, that number to be called the Transmission Number. This feature reduces the overall number of RF transmissions and thus provides greater efficiency with regard to conserving battery energy and increasing battery life.

In this embodiment, the Peripheral Unit encodes each RF transmission with a value corresponding to the countdown from the Transmission Number to 1, that value to be called the Transmission Index. For example, if the Transmission Number is 10, then the transmissions after the last sensed motion are encoded with Transmission Indices from 10 to 1 respectively, counting backward with integer values. At each instance of sensed motion, the Peripheral Unit processing method resets the Transmission Index of the subsequent transmission to the Transmission Number.

When the Base Unit receives a transmission encoded with a Transmission Index equal to the Transmission Number, the Base Unit processing method can infer that the corresponding Peripheral Unit and golf club are in close proximity to the bag and have experienced motion within the last Polling Interval. In this case, said Peripheral Unit is counted as in or close to the bag for the current inventory.

When the Base Unit receives a transmission from a Peripheral Unit encoded with a Transmission Index less than the Transmission Number and the Base Unit has not experienced motion since it received the previous transmission from that Peripheral Unit, the Base Unit processing method can infer that this Peripheral Unit and the corresponding golf club are in close proximity to the bag and have not experienced motion within the last Polling Interval, and that the bag is stationary. In this case, said Peripheral Unit is counted as in or close to the bag for the current inventory.

When the Base Unit has not received a transmission from a Peripheral Unit within a directly preceding duration of time greater than the Polling Interval, and the Base Unit has not experienced motion since it received the previous transmission from that Peripheral Unit, and the Transmission Index of that previous transmission was 1, the Base Unit processing method can infer that this Peripheral Unit and the corresponding golf club are in close proximity to the bag and that the Peripheral Unit has ceased transmitting due to lack of motion (i.e. it has "gone to sleep"), and that the bag is stationary. In this case, said Peripheral Unit is counted as in or close to the bag for the current inventory.

When the Base Unit receives a transmission from a Peripheral Unit encoded with a Transmission Index less than the Transmission Number and the Base Unit has experienced motion since it received the previous transmission from that Peripheral Unit, the Base Unit processing method can infer that this Peripheral Unit and the corresponding golf club are in close proximity to the bag but are not actually in the bag, since the bag moved without causing that club to move. In this case, said Peripheral Unit is counted as out of the bag for the current inventory.

When the Base Unit receives a transmission from a Peripheral Unit encoded with a Transmission Index greater than 1, and then receives no further transmission from that Peripheral Unit for a duration of time greater than the Polling Interval, the Base Unit processing method can infer that this Peripheral Unit and the corresponding golf club are no longer in close proximity to the bag. In this case, said Peripheral Unit is counted as out of the bag for the current inventory.

When the Base Unit experiences motion and then receives no transmission from a Peripheral Unit for a duration of time greater than the Polling Interval, the Base Unit processing method can infer that this Peripheral Unit and the corresponding golf club are not in close proximity to the bag. In this case, said Peripheral Unit is counted as out of the bag for the current inventory.

It may be useful to indicate certain status information to the user. This information may be indicated via various means such as one or more LED, LCD, OLED, and sound-emitting elements. Examples of such status indications are given here:

When all Peripheral Units and corresponding clubs were counted as in the bag for the most recent inventory, a particular LED, e.g. a green or blue LED, may be lit.

When a single Peripheral Unit and corresponding club were counted as out of the bag for the most recent inventory, there may be no LED lit.

When a single Peripheral Unit and corresponding club were counted as out of the bag in a previous inventory, and the Base Unit has experienced motion since that inventory, a particular LED, e.g. a red or orange LED, may be lit.

When two or more Peripheral Units and corresponding clubs were counted as out of the bag for the most recent inventory, a particular LED, e.g. a red or orange LED, may flash slowly.

When the alarm of FIG. 5 is activated, a particular LED, e.g. a red or orange LED, may flash quickly.

When the alarm of FIG. 5 is activated and the Base Unit has experienced motion since the alarm was activated, a sound-emitting element may emit a sound, i.e. an audible alert.

In one embodiment, the base unit may record certain aspects of a golfer's performance based on signals received from the peripheral units. For example, the base unit may keep track of the number of strokes taken by the golfer and may use this information to tabulate the golfer's score.

In an embodiment wherein the base unit contains a GPS device, or the base unit is a mobile telephone containing a GPS device, or the base unit is in communication with either a mobile telephone containing a GPS device or other separate product containing a GPS device, certain other functionality may be enabled. For example the Processing Segment 60 of the base unit in such an embodiment may calculate the distance a ball is hit with a particular golf club as follows:

a) detect when that golf club is removed from the golf bag;
b) record a location associated with the user as received from the GPS device at the time when that club is removed from the golf bag;
c) detect when the next golf club is removed from the golf bag;
d) record a location associated with the user as received from the GPS device at the time when that next club is removed from the golf bag; and
e) compare the two locations to estimate the distance a ball was hit with the first club.

Certain software running within the base unit or elsewhere may compile many such instances into statistical information that may be quite valuable to the golfer in analyzing performance and making playing and training decisions accordingly.

In an embodiment wherein the peripheral unit contains a 3-axis accelerometer 19, RF transmissions may be disabled to conserve electrical power at certain times when it can be assumed that the clubs are not in use, for example when the accelerometer 19 senses that the clubs are horizontal and therefore can be assumed to be in a car.

What has been described above includes examples of multiple embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A system comprising:

a) a peripheral unit affixed to each golf club of a group of golf clubs operative to transmit radio frequency (RF) signals;

b) a base unit operative to detect RF signals from each peripheral unit and operative to process such signals in conjunction with location data from a Global Positioning System device; and c) a means for determining when a golf club of the group of golf clubs is put into use, wherein the location from the Global Positioning System device when a first golf club is put into use is compared to the location from the Global Positioning System device when a second golf club is put into use to estimate the distance a ball was hit using the first golf club.

2. The system according to claim 1 wherein:

a) each peripheral unit has a memory operative to store a unique identifier, and each peripheral unit associated with a golf club transmits a unique identifier;

b) the base unit has a limited range throughout which to receive RF signals from each peripheral unit; and c) a golf club is determined to be put into use based upon when the peripheral unit of the golf club is outside the limited range and thus its associated unique identifier is not received by the base unit.

3. The system according to claim 1 wherein:

a) the base unit is operative to ascertain the magnitude of RF signals received from each peripheral unit; and b) a golf club is determined to be put into use based upon when the magnitude of its RF signals is ascertained to be below a threshold value.

4. The system according to claim 1 further comprising a motion sensor inherent to each peripheral unit.

5. The system according to claim 4 wherein a golf club is determined to be put into use based upon signals from the motion sensor inherent to the peripheral unit of the golf club.

6. The system according to claim 4 wherein the motion sensor comprises a three-axis accelerometer.

7. The system according to claim 4 wherein the motion sensor comprises a three-axis gyroscope.

8. The system according to claim 1 wherein the base unit is a mobile telephone.

9. The system according to claim 1 wherein the base unit communicates with a mobile telephone.

10. The system according to claim 1 wherein the base unit contains a Global Positioning System device.

11. The system according to claim 1 wherein the base unit communicates with a separate device that contains a Global Positioning System device.

12. The system according to claim 1 wherein the RF signals employ the Bluetooth frequency and protocol.

13. The system according to claim 1 further comprising a passive radio frequency identification (RFID) tag in each peripheral unit, wherein the RF signals of a peripheral unit are generated by its passive RFID tag due to RF radiation incident on the tag from an RFID reader device.

14. The system according to claim 13 wherein the RFID reader device is integrated to a golf bag containing the group of golf clubs.

15. The system of claim 13 wherein the RFID reader device is connected to an antenna that is integrated to a golf bag containing the group of golf clubs.

16. The system according to claim 4 wherein the peripheral unit of a golf club is operative to employ signals from its motion sensor to determine when a golf club has been motionless for some period of time, and cease RF signal transmissions accordingly to conserve electrical power.

17. A method for determining the distance a ball is hit with a golf club comprising a) determining when a first golf club is put into use;

b) recording a location associated with the user as received from a Global Positioning System device at the time when the first golf club is put into use;

c) determining when a second golf club is put into use;

d) recording a location associated with the user as received from a Global Positioning System device at the time when the second golf club is put into use; and e) comparing the two locations to estimate the distance a ball was hit with the first golf club.

18. The method according to claim 17 further comprising:

a) periodically inventorying golf clubs in a group of golf clubs whereby a unique identifier is transmitted from a peripheral unit associated with each golf club and operative to transmit signals throughout a limited range;

b) storing the unique identifier received from each peripheral unit in a memory; and c) comparing the unique identifiers received to a known full set of unique identifiers for the group of golf clubs, to determine when a golf club of the group of golf clubs is put into use.

19. The method according to claim 17 further comprising:

a) periodically inventorying golf clubs in a group of golf clubs whereby a unique identifier is transmitted via RF from a peripheral unit associated with each golf club;

b) ascertaining the magnitude of the RF signals used to transmit each unique identifier;

c) storing the unique identifier and associated signal magnitude received from each peripheral unit in a memory; and d) comparing the signal magnitudes associated with each unique identifier to a threshold value to determine when a golf club of the group of golf clubs is put into use.

20. The method according to claim 17 further comprising processing signals from a motion sensor inherent to a peripheral unit associated with a golf club to determine when the golf club is put into use.

* * * * *